US005686791A

United States Patent [19]

Kumar et al.

[11] Patent Number: 5,686,791

[45] Date of Patent: *Nov. 11, 1997

[54] AMORPHIC DIAMOND FILM FLAT FIELD EMISSION CATHODE

[75] Inventors: Nalin Kumar, Austin; Chenggang Xie, Cedar Park, both of Tex.

[73] Assignee: Microelectronics and Computer Technology Corp., Austin, Tex.

[ * ] Notice: The term of this patent shall not extend beyond the expiration date of Pat. No. 5,449,970.

[21] Appl. No.: 479,480

[22] Filed: Jun. 7, 1995

Related U.S. Application Data

[60] Division of Ser. No. 71,157, Jun. 2, 1993, which is a continuation-in-part of Ser. No. 851,701, Mar. 16, 1992, abandoned.

[51] Int. Cl.[6] ..... H01J 1/30

[52] U.S. Cl. ..... 313/495; 313/310; 313/311; 313/496; 315/169.4

[58] Field of Search ..... 313/495, 496, 313/310, 311, 336; 315/169.4, 169.3

[56] References Cited

U.S. PATENT DOCUMENTS

| | | |
|---|---|---|
| 1,954,691 | 4/1934 | Hendrick de Boer et al. . |
| 2,851,408 | 9/1958 | Cerulli et al. . |
| 2,867,541 | 1/1959 | Coghill et al. . |
| 2,959,483 | 11/1960 | Kaplan . |
| 3,070,441 | 12/1962 | Schwartz . |
| 3,108,904 | 10/1963 | Cusano . |
| 3,259,782 | 7/1966 | Shroff . |
| 3,314,871 | 4/1967 | Heck et al. . |
| 3,360,450 | 12/1967 | Hays . |
| 3,481,733 | 12/1969 | Evans . |
| 3,525,679 | 8/1970 | Wilcox et al. . |
| 3,554,889 | 1/1971 | Hyman et al. . |
| 3,665,241 | 5/1972 | Spindt et al. . |
| 3,675,063 | 7/1972 | Spindt et al. . |

(List continued on next page.)

FOREIGN PATENT DOCUMENTS

2632436

OTHER PUBLICATIONS

"A new vacuum–etched high–transmittance (antireflection) film," *Appl. Phys. Lett.*, 1980, pp. 727–730.

"A Silicon Field Emitter Array Planar Vacuum FET Fabricated with Microfabrication Techniques," *Mat. Res. Soc. Symp. Proc.*, vol. 76, 1987, pp. 25–30.

"A Technique for Controllable Seeding of Ultrafine Diamond Particles for Growth and Selective–Area Deposition of Diamond Films," *2nd International Conference on the Applications of Diamond Films and Related Materials*, 1993, pp. 475–480.

"Computer Simulations in the Design of Ion Beam Deflection Systems," *Nuclear Instruments and Methods in Physics Research*, vol. B10, No. 11, 1985, pp. 817–821.

"Cone formation as a result of whisker growth on ion bombarded metal surfaces," *J. Vac. Sci. Technol. A*, vol. 3, No. 4, Jul./Aug. 1985, pp. 1821–1834.

"Cone Formation on Metal Targets During Sputtering," *J. Appl. Physics*, vol. 42, No. 3, Mar. 1, 1971, pp. 1145–1149.

"Control of silicon field emitter shape with isotrophically etched oxide masks," *Inst. Phys. Conf. Ser. No. 99: Section 2*, Presented at 2nd Int. Conf. on Vac. Microelectron., Bath, 1989, pp. 37–40.

(List continued on next page.)

*Primary Examiner*—Sandra L. O'Shea
*Assistant Examiner*—Matthew J. Esserman
*Attorney, Agent, or Firm*—Kelly K. Kordzik; Winstead Sechrest & Minick P.C.

[57] ABSTRACT

A field emission cathode for use in flat panel displays is disclosed comprising a layer of conductive material and a layer of amorphic diamond film, functioning as a low effective work-function material, deposited over the conductive material to form emission sites. The emission sites each contain at least two sub-regions having differing electron affinities. Use of the cathode to form a computer screen is also disclosed along with the use of the cathode to form a fluorescent light source.

6 Claims, 2 Drawing Sheets

U.S. PATENT DOCUMENTS

| | | |
|---|---|---|
| 3,743,881 | 7/1973 | Blaszuk . |
| 3,755,704 | 8/1973 | Spindt et al. . |
| 3,789,471 | 2/1974 | Spindt et al. . |
| 3,808,048 | 4/1974 | Strik . |
| 3,812,559 | 5/1974 | Spindt et al. . |
| 3,855,499 | 12/1974 | Yamada et al. . |
| 3,898,146 | 8/1975 | Rehkopf et al. . |
| 3,947,716 | 3/1976 | Fraser, Jr. et al. . |
| 3,970,887 | 7/1976 | Smith et al. . |
| 3,998,678 | 12/1976 | Fukase et al. . |
| 4,008,412 | 2/1977 | Yuito et al. . |
| 4,075,535 | 2/1978 | Genequand et al. . |
| 4,084,942 | 4/1978 | Villalobos . |
| 4,139,773 | 2/1979 | Swanson . |
| 4,141,405 | 2/1979 | Spindt . |
| 4,143,292 | 3/1979 | Hosoki et al. . |
| 4,164,680 | 8/1979 | Villalobos . |
| 4,168,213 | 9/1979 | Hoeberechts . |
| 4,178,531 | 12/1979 | Alig . |
| 4,307,507 | 12/1981 | Gray et al. . |
| 4,350,926 | 9/1982 | Shelton . |
| 4,482,447 | 11/1984 | Mizuguchi et al. . |
| 4,498,952 | 2/1985 | Christensen . |
| 4,507,562 | 3/1985 | Braunlich et al. . |
| 4,512,912 | 4/1985 | Matsuda et al. . |
| 4,513,308 | 4/1985 | Greene et al. . |
| 4,540,983 | 9/1985 | Morimoto et al. . |
| 4,542,038 | 9/1985 | Odaka et al. . |
| 4,578,614 | 3/1986 | Gray et al. . |
| 4,588,921 | 5/1986 | Tischer . |
| 4,594,527 | 6/1986 | Genevese . |
| 4,633,131 | 12/1986 | Khurgin . |
| 4,647,400 | 3/1987 | Dubroca et al. . |
| 4,663,559 | 5/1987 | Christensen . |
| 4,684,353 | 8/1987 | deSouza . |
| 4,684,540 | 8/1987 | Schulze . |
| 4,685,996 | 8/1987 | Busta et al. . |
| 4,687,825 | 8/1987 | Sagou et al. . |
| 4,687,938 | 8/1987 | Tamura et al. . |
| 4,710,765 | 12/1987 | Ohkoshi et al. . |
| 4,721,885 | 1/1988 | Brodie . |
| 4,728,851 | 3/1988 | Lambe . |
| 4,758,449 | 7/1988 | Kimura et al. . |
| 4,763,187 | 8/1988 | Biberian . |
| 4,780,684 | 10/1988 | Kosmahl . |
| 4,788,472 | 11/1988 | Katakami . |
| 4,816,717 | 3/1989 | Harper et al. . |
| 4,818,914 | 4/1989 | Brodie . |
| 4,822,466 | 4/1989 | Rabalais et al. . |
| 4,827,177 | 5/1989 | Lee et al. . |
| 4,835,438 | 5/1989 | Baptist et al. . |
| 4,851,254 | 7/1989 | Yamamoto et al. . |
| 4,855,636 | 8/1989 | Busta et al. . |
| 4,857,191 | 8/1989 | Borel et al. . |
| 4,857,799 | 8/1989 | Spindt et al. . |
| 4,874,981 | 10/1989 | Spindt . |
| 4,882,659 | 11/1989 | Gloudemans . |
| 4,889,690 | 12/1989 | Lubbers et al. . |
| 4,892,757 | 1/1990 | Kasenga et al. . |
| 4,899,081 | 2/1990 | Kishino et al. . |
| 4,900,584 | 2/1990 | Tuenge et al. . |
| 4,908,839 | 3/1990 | Meyer . |
| 4,923,421 | 5/1990 | Brodie et al. . |
| 4,926,056 | 5/1990 | Spindt . |
| 4,933,108 | 6/1990 | Soredal . |
| 4,940,916 | 7/1990 | Borel et al. . |
| 4,943,343 | 7/1990 | Bardai et al. . |
| 4,956,202 | 9/1990 | Kasenga et al. . |
| 4,956,573 | 9/1990 | Kane . |
| 4,964,946 | 10/1990 | Gray et al. . |
| 4,987,007 | 1/1991 | Wagal et al. . |
| 4,990,416 | 2/1991 | Mooney . |
| 4,990,766 | 2/1991 | Simms et al. . |
| 4,994,205 | 2/1991 | Towers . |
| 5,007,873 | 4/1991 | Goronkin et al. . |
| 5,015,912 | 5/1991 | Spindt et al. . |
| 5,019,003 | 5/1991 | Chason . |
| 5,036,247 | 7/1991 | Watanabe et al. . |
| 5,038,070 | 8/1991 | Bardai et al. . |
| 5,043,715 | 8/1991 | Kun et al. . |
| 5,054,046 | 10/1991 | Shoulders . |
| 5,054,047 | 10/1991 | Shoulders . |
| 5,055,077 | 10/1991 | Kane . |
| 5,055,744 | 10/1991 | Tsuruoka . |
| 5,057,047 | 10/1991 | Greene et al. . |
| 5,063,323 | 11/1991 | Longo et al. . |
| 5,063,327 | 11/1991 | Brodie et al. . |
| 5,064,396 | 11/1991 | Spindt . |
| 5,066,883 | 11/1991 | Yoshioka et al. . |
| 5,075,591 | 12/1991 | Holmberg . |
| 5,075,595 | 12/1991 | Kane . |
| 5,075,596 | 12/1991 | Young etal. . |
| 5,079,476 | 1/1992 | Kane . |
| 5,085,958 | 2/1992 | Jeong . |
| 5,089,292 | 2/1992 | McCaulay et al. . |
| 5,089,742 | 2/1992 | Kirkpatrick et al. . |
| 5,089,812 | 2/1992 | Fuse . |
| 5,090,932 | 2/1992 | Dieumegard et al. . |
| 5,098,737 | 3/1992 | Collins et al. . |
| 5,101,137 | 3/1992 | Kun et al. . |
| 5,101,288 | 3/1992 | Ohta et al. . |
| 5,103,144 | 4/1992 | Dunham . |
| 5,103,145 | 4/1992 | Doran . |
| 5,117,267 | 5/1992 | Kimoto et al. . |
| 5,117,299 | 5/1992 | Kondo et al. . |
| 5,119,386 | 6/1992 | Narusawa . |
| 5,123,039 | 6/1992 | Shoulders . |
| 5,124,072 | 6/1992 | Dole et al. . |
| 5,124,588 | 6/1992 | Soltani et al. . |
| 5,126,287 | 6/1992 | Jones . |
| 5,129,850 | 7/1992 | Kane et al. . |
| 5,132,585 | 7/1992 | Kane et al. . |
| 5,132,676 | 7/1992 | Kimura et al. . |
| 5,136,764 | 8/1992 | Vasquez . |
| 5,138,237 | 8/1992 | Kane et al. . |
| 5,140,219 | 8/1992 | Kane . |
| 5,141,459 | 8/1992 | Zimmerman . |
| 5,141,460 | 8/1992 | Jaskie et al. . |
| 5,142,184 | 8/1992 | Kane . |
| 5,142,256 | 8/1992 | Kane . |
| 5,142,390 | 8/1992 | Ohta et al. . |
| 5,144,191 | 9/1992 | Jones et al. . |
| 5,148,078 | 9/1992 | Kane . |
| 5,148,461 | 9/1992 | Shoulders . |
| 5,150,011 | 9/1992 | Fujieda . |
| 5,150,192 | 9/1992 | Greene et al. . |
| 5,151,061 | 9/1992 | Sandhu . |
| 5,153,753 | 10/1992 | Ohta et al. . |
| 5,153,901 | 10/1992 | Shoulders . |
| 5,155,420 | 10/1992 | Smith . |
| 5,156,770 | 10/1992 | Wetzel et al. . |
| 5,157,304 | 10/1992 | Kane et al. . |
| 5,157,309 | 10/1992 | Parker et al. . |
| 5,162,704 | 11/1992 | Kobori et al. . |
| 5,166,456 | 11/1992 | Masahiko . |
| 5,173,634 | 12/1992 | Kane . |
| 5,173,635 | 12/1992 | Kane . |
| 5,173,697 | 12/1992 | Smith et al. . |
| 5,180,951 | 1/1993 | Dworsky et al. . |
| 5,183,529 | 2/1993 | Potter et al. . |
| 5,185,178 | 2/1993 | Koskenmaki . |

5,186,670 2/1993 Doan et al. .
5,187,578 2/1993 Kohgami et al. .
5,191,217 3/1993 Kane et al. .
5,192,240 3/1993 Komatsu .
5,194,780 3/1993 Meyer .
5,199,917 4/1993 MacDonald et al. .
5,199,918 4/1993 Kumar .
5,201,992 4/1993 Marcus et al. .
5,202,571 4/1993 Hinabayashi et al. .
5,203,731 4/1993 Zimmerman .
5,204,021 4/1993 Dole .
5,204,581 4/1993 Andreadakis et al. .
5,205,770 4/1993 Lowrey et al. .
5,209,687 5/1993 Konishi .
5,210,430 5/1993 Taniguchi et al. .
5,210,462 5/1993 Konishi .
5,212,426 5/1993 Kane .
5,213,712 5/1993 Dole .
5,214,346 5/1993 Komatsu .
5,214,347 5/1993 Gray .
5,214,416 5/1993 Kondo et al. .
5,220,725 6/1993 Chan et al. .
5,227,699 7/1993 Busta .
5,228,877 7/1993 Allaway et al. .
5,228,878 7/1993 Komatsu .
5,229,331 7/1993 Doan et al. .
5,229,682 7/1993 Komatsu .
5,231,606 7/1993 Gray .
5,232,549 8/1993 Cathey et al. .
5,233,263 8/1993 Cronin et al. .
5,235,244 8/1993 Spindt .
5,236,545 8/1993 Pryor .
5,242,620 9/1993 Dole et al. .
5,243,252 9/1993 Kaneko et al. .
5,250,451 10/1993 Chouan .
5,252,833 10/1993 Kane et al. .
5,256,888 10/1993 Kane .
5,259,799 11/1993 Doan et al. .
5,262,698 11/1993 Dunham .
5,266,155 11/1993 Gray .
5,275,967 1/1994 Taniguchi et al. .
5,276,521 1/1994 Mori et al. .
5,277,638 1/1994 Lee .
5,278,475 1/1994 Jaskie et al. .
5,281,890 1/1994 Kane .
5,281,891 1/1994 Kaneko et al. .
5,283,500 2/1994 Kochanski .
5,283,501 2/1994 Zhu et al. ..... 315/169.3
5,285,129 2/1994 Takeda et al. .
5,296,117 3/1994 De Jaeger et al. .
5,300,862 4/1994 Parker et al. .
5,302,423 4/1994 Tran et al. .
5,308,439 5/1994 Cronin et al. .
5,312,514 5/1994 Kumar .
5,312,777 5/1994 Cronin et al. .
5,315,393 5/1994 Mican .
5,329,207 7/1994 Cathey et al. .
5,330,879 7/1994 Dennison .
5,341,063 8/1994 Kumar .
5,347,201 9/1994 Liang et al. .
5,347,292 9/1994 Ge et al. .
5,357,172 10/1994 Lee et al. .
5,368,681 11/1994 Hiraoka et al. .
5,378,963 1/1995 Ikeda .
5,380,546 1/1995 Kirshnan et al. .
5,387,844 2/1995 Browning .
5,393,647 2/1995 Neukermans et al. .
5,396,150 3/1995 Wu et al. .
5,399,238 3/1995 Kumar .
5,401,676 3/1995 Lee .
5,402,041 3/1995 Kishino et al. .
5,404,070 4/1995 Tsai et al. .
5,408,161 4/1995 Kishino et al. .
5,410,218 4/1995 Hush .
5,412,285 5/1995 Komatsu .
5,449,970 9/1995 Kumar et al. . ... 12/1989 .. France .

OTHER PUBLICATIONS

"Deposition of diamond–like carbon," *Phil. Trans. R. Soc. Land. A,* vol. 342, 1993, pp. 277–286.

"Fabrication of encapsulated silicon–vacuum field–emission transistors and diodes", *J. Vac. Sci. Technol. B,* vol. 10, No. 6, Nov./Dec. 1992, pp. 2984–2988.

"Fabrication of gated silicon field–emission cathodes for vacuum microelectronics and electron–beam applications," *J. Vac. Sci. Technol. B,* vol. 11, No. 2, Mar./Apr. 1993, pp. 454–458.

"Fabrication of silicon field emission points for vacuum microelectronics by wet chemical etching," *Semicond. Sci. Technol.,* vol. 6, 1991, pp. 223–225.

"Fabrication of 0.4 μm grid apertures for field–emission array cathodes," *Microelectronic Engineering,* vol 21, 1993, pp. 467–470.

"Growth of diamond particles on sharpened silicon tips," *Materials Letters,* vol. 18, No. 1.2, 1993, pp. 61–63.

"Interference and diffraction in globular metal films," *J. Opt. Soc. Am.,* vol. 68, No. 8, Aug. 1978, pp. 1023–1031.

"Oxidation sharpening of silicon tips," *J. Vac. Sci. Technol. B,* vol. 9, No. 6, Nov./Dec. 1991, pp. 2733–2737.

"Physical properties of thin film field emission cathodes with molybdenum cones," *Journal of Applied Physics,* vol. 47, No. 12, 1976, pp. 5248–5263.

"Recent Progress in Low–Voltage Field–Emission Cathode Development," *Journal de Physique,* Colloque C9, supp. au No. 12, Tome 45, Dec. 12984, pp. C9–269–278.

"The influence of surface treatment on field emission from silicon microemitters," *J. Phys.: Condens. Matter,* vol. 3, 1991, pp. S231–S236.

"Topography: Texturing Effects," *Handbook of Ion Beam Processing Technology,* Chapter 17, pp. 338–361.

"Ultrasharp tips for field emission applications prepared by the vapor–liquid–solid growth technique," *J. Vac. Sci. Technol. B,* vol. 11, No. 2, Mar./Apr. 1993, pp. 449–453.

"A Comparative Study of Deposition of Thin Films by Laser Induced PVD with Femtosecond and Nanosecond Laser Pulses," *SPIE,* vol. 1858, 1993, pp. 464–475.

"Amorphic diamond films produced by a laser plasma source," *J. Appl. Physics,* vol. 67, No. 4, Feb. 15, 1990, pp. 2081–2087.

"Characterization of laser vaporization plasmas generated for the deposition of diamond–like carbon," *J. Appl. Phys.,* vol. 72, No. 9, Nov. 1, 1992, pp. 3966–3970.

"Cold Field Emission From CVD Diamond Films Observed in Emission Electron Microscopy," Dept. of Physics & Astronomy & the Condensed Matter & Surface Science Program, Ohio University, Athens, Ohio, Jun. 10, 1991.

"Current Display Research–A Survey," Zenith Radio Corporation.

"Deposition of Amorphous Carbon Films from Laser–Produced Plasmas," *Mat. Res. Soc. Sump. Proc.,* vol. 38, 1985, pp. 326–335.

"Development of Nano–Crystaline Diamond–Based Field–Emission Displays," *SID 94Digest,* 1994, pp. 43–45.

"Diamond Cold Cathode," *IEEE Electron Device Letters,* vol. 12, No. 8, Aug. 1991, pp. 456–459.

"Diamond–like carbon films prepared with a laser ion source," *Appl. Phys. Lett.*, vol. 53, No. 3, 18 Jul. 1988, pp. 187–188.

"Direct Observation of Laser–Induced Crystallization of a–C:H Films," *Appl. Phys. A.* vol. 58, 1994, pp. 137–144.

"Emission spectroscopy during excimer laser ablation of graphite," *Appl. Phys. Letters,* vol. 57, No. 21, 19 Nov. 1990, pp. 2178–2180.

"Enhanced cold–cathode emission using composite resin–carbon coatings," Dept. of Electronic Eng. & Applied Physics, Aston Univ., Aston Triangle, Birmingham, UK, 29 May 1987.

"High Temperature Chemistry in Laser Plumes," *John L. Margrave Research Symposium,* Rice University, Apr. 29, 1994.

"Imaging and Characterization of Plasma Plumes Produced During Laser Ablation of Zirconium Carbide," D.P. Butt and P.J. Wantuck *Materials Research Society Symposium Proceedings,* vol. 285, pp. 81–86 (Laser Ablation in Materials Processing: Fundamentals and Applications–symposium held Dec. 1–4, 1992, Boston, Mass.).

"Laser–Assisted Selective Area Metallization of Diamond Surface by Electroless Nickel Plating," International Conference on the Applications of Diamond Films and Related Materials, 1993, pp. 303–306.

"Laser plasma source of amorphic diamond," *Appl. Phys. Lett.*, vol. 54, No. 3, Jan. 16, 1989, pp. 216–218.

"Optical characterization of thin film laser deposition processes," *SPIE,* vol. 1594, Process Module Metrology, Control, and Clustering, 1991, pp. 411–417.

"Optical Emission Diagnostics of Laser–Induced Plasma for Diamond–like Film Deposition," *Applied Physics A–Solids and Surfaces,* vol. 52, 1991, pp. 328–334.

"Optical observation of plumes formed at laser ablation of carbon materials," *Applied Surface Science,* vol. 79/80, 1994, pp. 141–145.

"Spatial characteristics of laser pulsed plasma deposition of thin films," *SPIE,* vol. 1352, Laser Surface Microprocessing, 1989, pp. 95–99.

"Species Temporal and Spatial Distributions in Laser Ablation Plumes," J.W. Hastie, et al., *Materials Research Society Symposium Proceedings,* vol. 285, pp. 39–44 (Laser Ablation in Materials Processing: Fundamentals and Applications– symposium held Dec. 1–4, 1992, Boston, Mass.).

"The bonding of protective films of amorphic diamond to titanium," *J. Appl. Phys.*, vol. 71, No. 7, 1 Apr. 1992, pp. 3260–3265.

"Thermochemistry of materials by laser vaporization mass spectrometry: 2. Graphite," *High Temperatures–High Pressures,* vol. 20, 1988, pp. 73–89.

"A Comparison of the Transmission Coefficient and the Wigner Function Approaches to Field Emission," *COMPEL,* vol. 11, No. 4, 1992, pp. 457–470.

"A New Model for the Replacement Process in Electron Emission at High Fields and Temperatures," Dept. of Physics, The Penn. State Univ., University Park, PA.

"Angle–resolved photoemission of diamond (111) and (100) surfaces; negative electron affinity and band structure measurements," *J. Vac. Sci. Technol. B,* vol. 12, No. 4, Jul./Aug. 1994, pp. 2475–2479.

"Angular Characteristics of the Radiation by Ultra Relativistic Electrons in Thick Diamond Single Crystals," *Sov. Tech. Phys. Lett.*, vol. 11, No. 11, Nov. 1985, pp. 574–575.

"Argon and hydrogen plasma interactions on diamond (111) surfaces: Electronic states and structure," *Appl. Phys. Lett.*, vol. 62, No. 16, 19 Apr. 1993, pp. 1878–1880.

"A Theoretical Study on Field Emission Array for Microsensors," *IEEE Transactions on Electron Devices,* vol. 39, No. 2, Feb. 1992, pp. 313–324.

"A Wide–Bandwidth High–Gain Small–Size Distributed Amplifier with Field–Emission Triodes (FETRODE's) for the 10 to 300 GHz Frequency Range," *IEEE Transactions on Electron Devices,* vol. 36, No. 11, Nov. 1989, pp. 2728–2737.

"Capacitance–Voltage Measurements on Metal–$SiO_2$–Diamond Structures Fabricated with (100)–and (111)–Oriented Substrates," *IEEE Transactions on Electron Devices,* vol. 38, No. 3, Mar. 1991, pp. 619–626.

"Characterisation of the Field Emitting Properties of CVD Diamond Films," *Conference Record–1994 Tri–Service/NASA Cathode Workshop,* Cleveland, Ohio, Mar. 29–31, 1994, pp. 91–94.

"Collector–Assisted Operation of Micromachined Field–Emitter Triodes," *IEEE Transactions on Electron Devices,* vol. 40, No. 8, Aug. 1993, pp. 1537–1542.

"Collector–Induced Field Emission Triode," *IEEE Transactions on Electron Devices,* vol. 39, No. 11, Nov. 1992, pp. 2616–2620.

"Diamond–based field emission flat panel displays," *Solid State Technology,* May 1995, pp. 71–74.

"Diamond Cold Cathodes: Applications of Diamond Films and Related Materials," Elsevier Science Publishers BN, 1991, pp. 309–310 [copy to be provided].

"Diamond Field–Emission Cathodes," *Conference Record–1994 Tri–Service/NASA Cathode Workshop,* Cleveland, Ohio, Mar. 29–31, 1994.

"Diamond Field–Emission Cathode Technology," Lincoln Laboratory α MIT.

"Diamond–like nanocomposites (DLN)," *Thin Solid Films,* vol. 212, 1992, pp. 267–273.

"Diamond–like nanocomposites: electronic transport mechanisms and some applications," *Thin Solid Films,* vol. 212, 1992, pp. 274–281.

"Electrical characterization of gridded field emission arrays," *Inst. Phys. Conf. Ser. No. 99: Section 4* Presented at 2nd Int. Conf. on Vac. Microelectron., Bath, 1989, pp. 81–84.

"Electrical phenomena occurring at the surface of electrically stressed metal cathodes. I. Electro–luminescence and breakdown phenomena with medium gap spacings (2–8 mm)," *J. Phys. D: Appl. Phys.*, vol. 12, 1979, pp. 2229–2245.

"Electrical phenomena occurring at the surface of electrically stressed metal cathodes. II. Identification of electroluminescent (k–spot) radiation with electron emission on broad area cathodes," *J. Phys. D: Appl. Phys.*, vol. 12, 1979, pp. 2247–2252.

"Electroluminescence produced by high electric fields at the surface of copper cathodes," *J. Phys. D: Appl. Phys.*, vol. 10, 1977, pp. L195–L201.

"Electron emission from phosphorus–and boron–doped polycrystalline diamond films," *Electronics Letters,* vol. 31, No. 1, Jan. 1995, pp. 74–75.

"Electron Field Emission from Amorphic Diamond Thin Films," *6th International Vacuum Microelectronics Conference Technical Digest,* 1993, pp. 162–163.

"Electron Field Emission from Broad–Area Electrodes," *Applied Physics A–Solids and Surfaces,* vol. 28, 1982, pp. 1–24.
"Emission characteristics of metal–oxide–semiconductor electron tunneling cathode," *J. Vac. Sci. Technol. B,* vol. 11, No. 2, Mar./Apr. 1993, pp. 429–432.
"Emission Characteristics of Silicon Vacuum Triodes with Four Different Gate Geometries," *IEEE Transactions on Electron Devices,* vol. 40, No. 8, Aug. 1993, pp. 1530–1536.
"Emission Properties of Spindt–Type Cold Cathodes with Different Emission Cone Material",*IEEE Transactions on Electron Devices,* vol. 38, No. 10, Oct. 1991.
"Energy exchange processes in field emission from atomically sharp metallic emitters," *J. Vac. Sci. Technol. B,* vol. 11, No. 2, Mar./Apr. 1993, pp. 366–370.
"Enhanced Cold–Cathode Emission Using Composite Resin–Carbon Coating," Dept. of Electronic Eng. & Applied Phiscs, Aston Univ., Aston Triangle, Birmingham, UK, May 29, 1987.
"Experimental and theoretical determinations of gate–to–emitter stray capacitances of field emitters," *J. Vac. Sci. Technol. B,* vol. 11, No. 2, Mar./Apr. 1993, pp. 445–448.
"Fabrication and Characterization of Lateral Field–Emitter Triodes," *IEEE Transactions On Electron Devices,* vol. 38, No. 10, Oct. 1991, pp. 2334–2336.
"Field–Dependence of the Area–Density of 'Cold' Electron Emission Sites on Broad–Area CVD Diamond Films," *Electronics Letters,* vol. 29, No. 18, 2 Sep. 1993, pp. 1596–1597.
"Field Electron Energy Distributions for Atomically Sharp Emitters," The Penn. State Univ., University Park, PA.
*Field Emission and Field Ionization,* "Theory of Field Emission (Chapter 1) and Field–Emission Microscopy and Related Topics" (Chapter 2), Harvard Monographs in Applied Science, No. 9, Harvard University Press, Cambridge, Mass., 1961, pp. 1–63.
"Field Emission Cathode Technology and It's [sic]Applications," *Technical Digest Of IVMC 91,* Nagahama, 1991, pp. 40–43.
"Field Emission Characteristic Requirements for Field Emission Displays," *Conf. of 1994 Int. Display Research Conf. and Int. Workshops on Active–Matrix LCDs & Display Mat'ls,* Oct. 1994.
"Field emission device modeling for application to flat panel displays," *J. Vac. Sci–Technol. B,* vol. 11, No. 2, Mar./Apr. 1993, pp. 518–522.
"Field Emission Displays Based on Diamond Thin Films," *Society of Information Display Conference Technical Digest,* 1993, pp. 1009–1010.
"Field emission from silicon through an adsorbate layer," *J. Phys.: Condens. Matter,* vol. 3, 1991, pp. S187–S192.
"Field Emission from Tungsten–Clad Silicon Pyramids," *IEEE Transactions on Electron Devices,* vol. 36, No. 11, Nov. 1989, pp. 2679–2685.
"Field Emission Measurements with μm Resolution on CVD–Polycrystalline Diamond Films," To be published and presented at the 8th IVMC '95, Portland, Oregon.
"Field–emitter–array development for high–frequency operation," *J. Vac. Sci. Technol. B,* vol. 11, No. 2, Mar./Apr. 1993, pp. 468–473.
"Field Emitter Arrays Applied to Vacuum Fluorescent Display," *Journal de Physique,* Colloque C6, supp. au No. 11, Tome 49, Nov. 1988, pp. C6–153–154.
"Field Emitter Arrays–More Than a Scientific Curiosity?" *Colloque de Physique,* Colloque C8, supp. au No. 11, Tome 50, Nov. 1989, pp. C8–67–72.
"Field Emitter Array with Lateral Wedges," *Technical Digest Of IVMC 91,* Nagahama, 1991, pp. 50–51.
"Field emitter tips for vacuum microelectronic devices," *J. Vac. Sci. Technol. A,* vol. 8, No. 4, Jul./Aug. 1990, pp. 3586–3590.
"Field–induced electron emission through Langmuir–Blodgett multiplayers," Dept. of Electrical and Electronic Engineering and Applied Physics, Aston Univ., Birmingham, UK, Sep. 1987 (0022–3727/88/010148 +06).
"Field–Induced Photoelectron Emission from p–Type Silicon Aluminum Surface–Barrier Diodes," *Journal of Applied Physics,* vol. 41, No. 5, Apr. 1970, pp. 1945–1951.
"Flat–Panel Displays," *Scientific American,* Mar. 1993, pp. 90–97.
"Gated Field Emitter Failures: Experiment and Theory," *IEEE Transactions On Plasma Science,* vol. 20, No. 5, Oct. 1992, pp. 499–506.
"High–resolution simulation of field emission," *Nuclear Instruments and Methods in Physics Research* A298, 1990, pp. 39–44.
"Ion–space–charge initiation of gated field emitter failure," *J. Vac. Sci. Technol. B,* vol. 11, No. 2, Mar./Apr. 1993, pp. 441–444.
"Low–energy electron transmission and secondary–electron emission experiments on crystalline and molten long–chain alkanes," *Physical Review B,* vol. 34, No. 9, 1 Nov. 1986, pp. 6386–6393.
"Low Energy, Electron Transmission Measurements on Polydiacetylene Langmuir–Blodgett Films," *Thin Solid Films,* vol. 179, 1989, pp. 327–334.
"Measurement of gated field emitter failure", *Rev. Sci. Instrum.,* vol. 64, No. 2, Feb. 1993, pp. 581–582.
"Metal–Edge Field Emitter Array with a Self–Aligned Gate," *Technical Digest of IVMC 91,* Nagahama, 1991, pp. 46–47.
"Microstructural Gated Field Emission Sources for Electron Beam Applications," *SPIE,* vol. 1671, 1992, pp. 201–207.
"Microstructure of Areorphic Diamond Films," The Univ. of Texas at Dallas, Center for Quantum Electronics, Richardson, Texas.
"Microtip Field–Emission Display Performance Considerations," *SID 92 Digest,* pp. 523–526.
"Monoenergetic and Directed Electron Emission from a Large–Bandgap Organic Insulator with Negative Electron Affinity," *Europhysics Letters,* vol. 5, No. 4, 1988, pp. 375–380.
"Monte Carlo Simulation of Ballistic Charge Transport in Diamond under an Internal Electric Field," Dept. of Physics, The Penn. State Univ., University Park, PA, Mar. 3, 1995.
"Negative Electron Affinity and Low Work Function Surface: Cesium on Oxygenated Diamond (100)," *Physical Review Letters,* vol. 73, No. 12, 19 Sep. 1994, pp. 1664–1667.
"Numerical simulation of field emission from silicon," *J. Vac. Sci. Technol. B,* vol. 11, No. 2, Mar./Apr. 1993, pp. 371–378.
"Optical Recording in Diamond–Like Carbon Films," *JJAP Series 6, Proc. Int. Symp. On Optical Memory,* 1991, pp. 116–120.
"Optimization of Amorphic Diamond™ for Diode Field Emission Displays," Microelectronics and Computer Technology Corporation and SI Diamond Technology, Inc.
"Planer [sic] Field Emission Devices with Three–Dimensional Gate Structures," *Technical Digest of IVMC 91,* Nagahama 1991, pp. 78–79.

"Real-time, in situ photoelectron emission microscopy observation of CVD diamond oxidation and dissolution on molybdenum," *Diamond and Related Materials,* vol. 3, 1994, pp. 1066–1071.
"Recent Development on 'Microtips' Display at LETI," *Technical Digest Of IVMC 91,* Nagahama, 1991, pp. 6–9.
"Schottky barrier height and negative electron affinity of titanium on (111) diamond," *J. Vac. Sci. Technol. B,* vol. 10, No. 4, Jul./Aug. 1992, pp. 1940–1943.
"Sealed Vacuum Devices: Microchips Fluorescent Display," *3rd International Vacuum Microelectronics Conference,* Monterrey, U.S.A., Jul. 1990 [copy to be provided].
"Silicon Field Emitter Arrays for Cathodoluminescent Flat Panel Displays," CH-3071-8/91/0000-0141, 1991 IEEE.
"Simulation of Field Emission from Silicon: Self-Consistent Corrections Using the Wigner Distribution Function," *COMPEL,* vol. 12, No. 4, 1993, pp. 507–515.
"Single micromachined emitter characteristics," *J. Vac. Sci. Technol. B,* vol. 11, No. 2, Mar./Apr. 1993, pp. 396–399.
"Stability of the emission of a microtip," *J. Vac. Sci. Technol. B,* vol. 12, No. 2, Mar./Apr. 1994, pp. 685–688.
"Structure and Electrical Characteristics of Silicon Field-Emission Microelectronic Devices," *IEEE Transactions on Electron Devices,* vol. 38, No. 10, Oct. 1991, pp. 2309–2313.
"Substrate and Target Voltage Effects on Sputtered Hydrogenated Amorphous Silicon," *Solar Energy Materials.,* vol. 11, 1985, pp. 447–454.
"Synchrotron radiation photoelectron emission microscopy of chemical-vapor-deposited diamond electron emitters," *J. Vac. Sci. Technol. A,* vol. 13, No. 3, May/Jun. 1995, pp. 1–5.
"Temperature dependence of I-V characteristics of vacuum triodes from 24 to 300 K," *J. Vac. Sci. Technol. B,* vol. 11, No. 2, Mar./Apr. 1993, pp. 400–402.
"The Field Emission Display: A New Flat Panel Technology," CH-3071-8/91/0000-0012 501.00 © 1991 IEEE.
"The nature of field emission sites," *J. Phys. D: Appl. Phys.,* vol. 8, 1975, pp. 2065–2073.
"Theoretical study of field emission from diamond," *Appl. Phys. Lett.,* vol. 65, No. 20, 14 Nov. 1994, pp. 2562–2564.
"Theory of electron emission in high fields from atomically sharp emitters: Validity of the Fowler-Nordheim equation," *J. Vac. Sci. Technol. B,* vol. 11, No. 2, Mar./Apr. 1993, pp. 387–391.
"The Semiconductor Field-Emission Photocathode," *IEEE Transactions on Electron Devices,* vol. ED-21, No. 12, Dec. 1974, pp. 785–797.
"The SIDT/MCC Amorphic Diamond Cathode Field Emission Display Technology," *David Sarnoff Research Center-Client Study,* Mar. 1994.
"The source of high-β electron emission sites on broad-area high-voltage alloy electrodes," *J. Phys. D: Appl. Phys.,* vol. 12, 1979, pp. 969–977.
"Thin-Film Diamond," *The Texas Journal of Science,* vol. 41, No. 4, 1989, pp. 343–358.
"Thin Film Emitter Development," *Technical Digest Of IVMC 91,* Nagahama, 1991, pp. 118–119.
"Triode characteristics and vacuum considerations of evaporated silicon microdevices," *J. Vac. Sci. Technol. B,* vol 11, No. 2, Mar./Apr. 1993, pp. 422–425.
"Tunnelling theory and vacuum microelectronics," *Inst. Phys. Conf. Ser. No. 99: Section 5,* Presented at 2nd Int. Conf. on Vac. Microelectron., Bath, 1989, pp. 121–131.
"Ultrahigh-vacuum field emitter array wafer tester," *Rev. Sci. Instrum.,* vol. 58, No. 2, Feb. 1987, pp. 301–304.
"Use of Diamond Thin Films for Low Cost field Emissions Displays," *7th International Vacuum Microelectronics Conference Technical Digest,* 1994, pp. 229–232.
"Vacuum microtriode characteristics," *J. Vac. Sci. Technol. A,* vol. 8, No. 4, Jul./Aug. 1990, pp. 3581–3585.
"Wedge-Shaped Field Emitter Arrays for Flat Display," *IEEE Transactions on Electron Devices,* vol. 38, No. 10, Oct. 1991, pp. 2395–2397.
*Cathodoluminescence: Theory and Application,* Chapters 9 and 10, VCH Publishers, New York, NY, 1990.
"Cathodoluminescent Materials," *Electron Tube Design. D. Sarnoff Res. Center Yearly Reports & Review,* 1976, pp. 128–137.
"Electron Microscopy of Nucleation and Growth of Indium and Tin Films," *Philosophical Magazine,* vol. 26, No. 3, 1972, pp. 649–663.
"Improved Performance of Low Voltage Phosphors for Field Emission Displays," *SID Display Manufacturing Conf.,* Santa Clara, CA, Feb. 2, 1995.
"Phosphor Materials for Cathode-Ray Tubes," *Advances in Electronics and Electron Physics,* vol. 17, 1990, pp. 271–351.
"Phosphors and Screens," *Advances in Electronics and Electron Physics,* vol. 67, Academic Press, Inc., 1986, pp. 254, 272–273.
"The Chemistry of Artificial Lighting Devices-Lamps, Phosphors and Cathode Ray Tubes," *Studies in Inorganic Chemistry 17,* Elsevier Science Publishers B.V., The Netherlands, 1993, pp. 573–593.
Data Sheet on Anode Drive SN755769, Texas Instruments, pp. 4–81 to 4–88.
Data Sheet on Display Driver, HV38, Supertex, Inc., pp. 11–43 to 11–50.
Data Sheet on Voltage Driver, HV620, Supertex Inc., pp. 1–6, May 21, 1993.
Data Sheet on Voltage Drive, HV 622, Supertex Inc., pp. 1–5, Sep. 22, 1992.
"Light scattering from aggregated silver and gold films," *J. Opt. Soc. Am.,* vol. 64, No. 9, Sep. 1974, pp. 1190–1193.

AMORPHIC DIAMOND FILM FLAT FIELD EMISSION CATHODE

RELATED APPLICATION

This application is a divisional of Ser. No. 08/071,157, filed Jun. 2, 1993, which is a continuation-in-part of Ser. No. 07/851,701, which was filed on Mar. 16, 1992, entitled "Flat Panel Display Based on Diamond Thin Films" which applications are hereby incorporated herein by reference.

TECHNICAL FIELD OF THE INVENTION

This invention relates, in general, to flat field emission cathodes and, more particularly, to such cathodes which employ an amorphic diamond film having a plurality of emission sites situated on a flat emission surface.

BACKGROUND OF THE INVENTION

Field emission is a phenomenon which occurs when an electric field proximate the surface of an emission material narrows a width of a potential barrier existing at the surface of the emission material. This allows a quantum tunnelling effect to occur, whereby electrons cross through the potential barrier and are emitted from the material. This is as opposed to thermionic emission, whereby thermal energy within an emission material is sufficient to eject electrons from the material. Thermionic emission is a classical phenomenon, whereas field emission is a quantum mechanical phenomenon.

The field strength required to initiate field emission of electrons from the surface of a particular material depends upon that material's effective "work function." Many materials have a positive work function and thus require a relatively intense electric field to bring about field emission. Some materials do, in fact, have a low work function, or even a negative electron affinity, and thus do not require intense fields for emission to occur. Such materials may be deposited as a thin film onto a conductor, resulting in a cathode with a relatively low threshold voltage required to produce electron emissions.

In prior art devices, it was desirable to enhance field emission of electrons by providing for a cathode geometry which focussed electron emission at a single, relatively sharp point at a tip of a conical cathode (called a micro-tip cathode). These micro-tip cathodes, in conjunction with extraction grids proximate the cathodes, have been in use for years in field emission displays.

For example, U.S. Pat. No. 4,857,799, which issued on Aug. 15, 1989, to Spindt et al., is directed to a matrix-addressed flat panel display using field emission cathodes. The cathodes are incorporated into the display backing structure, and energize corresponding cathodoluminescent areas on a face plate. The face plate is spaced 40 microns from the cathode arrangement in the preferred embodiment, and a vacuum is provided in the space between the plate and cathodes. Spacers in the form of legs interspersed among the pixels maintain the spacing, and electrical connections for the bases of the cathodes are diffused sections through the backing structure. Spindt et al. employ a plurality of micro-tip field emission cathodes in a matrix arrangement, the tips of the cathodes aligned with apertures in an extraction grid over the cathodes. With the addition of an anode over the extraction grid, the display described in Spindt et al. is a triode (three terminal) display.

Unfortunately, micro-tips employ a structure which is difficult to manufacture, since the micro-tips have fine geometries. Unless the micro-tips have a consistent geometry throughout the display, variations in emission from tip to tip will occur, resulting in unevenness in illumination of the display. Furthermore, since manufacturing tolerances are relatively tight, such micro-tip displays are expensive to make.

For years, others have directed substantial effort toward solving the problem of creating cathodes which can be mass manufactured to tight tolerances, allowing them to perform with accuracy and precision. Another object of some of these prior art inventions was that they made use of emission materials having a relatively low effective work function so as to minimize extraction field strength.

One such effort is documented in U.S. Pat. No. 3,947,716, which issued on Mar. 30, 1976, to Fraser, Jr. et al., directed to a field emission tip on which a metal adsorbent has been selectively deposited. In a vacuum, a clean field emission tip is subjected to heating pulses in the presence of an electrostatic field to create thermal field build up of a selected plane. Emission patterns from this selected plane are observed, and the process of heating the tip within the electrostatic field is repeated until emission is observed from the desired plane. The adsorbent is then evaporated onto the tip. The tip constructed by this process is selectively faceted with the emitting planar surface having a reduced work function and the non-emitting planar surface as having an increased work function. A metal adsorbent deposited on the tip so prepared results in a field emitter tip having substantially improved emission characteristics. Unfortunately, as previously mentioned, such micro-tip cathodes are expensive to produce due to their fine geometries. Also, since emission occurs from a relatively sharp tip, emission is still somewhat inconsistent from one cathode to another. Such disadvantages become intolerable when many cathodes are employed in great numbers such as in a flat panel display for a computer.

As is evident in the above-described cathode structure, an important attribute of good cathode design is to minimize the work function of the material constituting the cathode. In fact, some substances such as alkali metals and elemental carbon in the form of diamond crystals display a low effective work function. Many inventions have been directed to finding suitable geometries for cathodes employing negative electron affinity substances as a coating for the cathode.

For instance, U.S. Pat. No. 3,970,887, which issued on Jul. 20, 1976, to Smith et al., is directed to a microminiature field emission electron source and method of manufacturing the same wherein a single crystal semiconductor substrate is processed in accordance with known integrated microelectronic circuit techniques to produce a plurality of integral, single crystal semiconductor raised field emitter tips at desired field emission cathode sites on the surface of a substrate in a manner such that the field emitters tips are integral with the single crystal semiconductor substrate. An insulating layer and overlying conductive layer may be formed in the order named over the semiconductor substrate and provided with openings at the field emission locations to form micro-anode structures for the field emitter tip. By initially appropriately doping the semiconductor substrate to provide opposite conductivity-type regions at each of the field emission locations and appropriately forming the conductive layer, electrical isolation between the several field emission locations can be obtained. Smith et al. call for a sharply-tipped cathode. Thus, the cathode disclosed in Smith et al. is subject to the same disadvantages as Fraser, Jr. et al.

U.S. Pat. No. 4,307,507, which issued on Dec. 29, 1981, to Gray et al., is directed to a method of manufacturing a field-emitter array cathode structure in which a substrate of single crystal material is selectively masked such that the unmasked areas define islands on the underlying substrate. The single crystal material under the unmasked areas is orientation-dependent etched to form an array of holes whose sides intersect at a crystal graphically sharp point.

U.S. Pat. No. 4,685,996, which issued on Aug. 11, 1987, to Busta et al., is also directed to a method of making a field emitter and includes an anisotropically etched single crystal silicon substrate to form at least one funnel-shaped protrusion on the substrate. The method of manufacturing disclosed in Busta et al. provides for a sharp-tipped cathode.

Sharp-tipped cathodes are further described in U.S. Pat. No. 4,855,636, which issued on Aug. 8, 1989, to Busta et al.

Yet another sharp-tipped emission cathode is disclosed in U.S. Pat. No. 4,964,946, which issued on Oct. 23, 1990, to Gray et al. Gray et al. disclose a process for fabricating soft-aligned field emitter arrays using a soft-leveling planarization technique, e.g. a spin-on process.

Even though they employ low effective work-function materials to advantage, sharp-tipped cathodes have fundamental problems when employed in a flat panel graphic display environment, as briefly mentioned above. First, they are relatively expensive to manufacture. Second, they are hard to manufacture with great consistency. That is, electron emission from sharp-tipped cathodes occurs at the tip. Therefore, the tip must be manufactured with extreme accuracy such that, in a matrix of adjacent cathodes, some cathodes do not emit electrons more efficiently than others, thereby creating an uneven visual display. In other words, the manufacturing of cathodes must be made more reliable so as to minimize the problem of inconsistencies in brightness in the display along its surface.

In Ser. No. 07/851,701, which was filed on Mar. 16, 1992, and entitled "Flat Panel Display Based on Diamond Thin Films," which was refiled as a continuation application Ser. No. 08/343,262, which is thus related and issued as U.S. Pat. No. 5,543,684 on Aug. 6, 1996, an alternative cathode structure was first disclosed. U.S. Pat. No. 5,543,684 discloses a cathode having a relatively flat emission surface as opposed to the aforementioned micro-tip configuration. The cathode, in its preferred embodiment, employs a field emission material having a relatively low effective work function. The material is deposited over a conductive layer and forms a plurality of emission sites, each of which can field-emit electrons in the presence of a relatively low intensity electric field.

Flat cathodes are much less expensive and difficult to produce in quantity because the fine, micro-tip geometry has been eliminated. The advantages of the flat cathode structure was discussed at length therein. The entirety of U.S. Pat. No. 5,543,684, which is commonly assigned with the present invention, is incorporated herein by reference.

A relatively recent development in the field of materials science has been the discovery of amorphic diamond. The structure and characteristics of amorphic diamond are discussed at length in "Thin-Film Diamond," published in the Texas Journal of Science, vol. 41, no. 4, 1989, by C. Collins et al. Collins et al. describe a method of producing amorphic diamond film by a laser deposition technique. As described therein, amorphic diamond comprises a plurality of micro-crystallites, each of which has a particular structure dependent upon the method of preparation of the film, The manner in which these micro-crystallites are formed and their particular properties are not entirely understood.

Diamond has a negative election affinity. That is, only a relatively low electric field is required to distort the potential barrier present at the surface of diamond. Thus, diamond is a very desirable material for use in conjunction with field emission cathodes. In fact, the prior art has employed crystalline diamond films to advantage as an emission surface on micro-tip cathodes.

In "Enhanced Cold-Cathode Emission Using Composite Resin-Carbon Coatings," published by S. Bajic and R. V. Latham from the Department of Electronic Engineering and Applied Physics, Aston University, Aston Triangle, Burmingham B4 7ET, United Kingdom, received May 29, 1987, a new type of composite resin-carbon field-emitting cathode is described which is found to switch on at applied fields as low as approximately 1.5 MV $m^{-1}$, and subsequently has a reversible I-V characteristic with stable emission currents of > or =1 mA at moderate applied fields of typically < or =8 MV $m^{-1}$. A direct electron emission imaging technique has shown that the total externally recorded current stems from a high density of individual emission sites randomly distributed over the cathode surface. The observed characteristics have been qualitatively explained by a new hot-electron emission mechanism involving a two-stage switch-on process associated with a metal-insulator-metal-insulator-vacuum (MIMIV) emitting regime. However, the mixing of the graphite powder into a resin compound results in larger grains, which results in fewer emission sites since the number of particles per unit area is small. It is preferred that a larger amount of sites be produced to produce a more uniform brightness from a low voltage source.

In "Cold Field Emission From CVD Diamond Films Observed In Emission Electron Microscopy," published by C. Wang, A. Garcia, D. C. Ingram, M. Lake and M. E. Kordesch from the Department of Physics and Astronomy and the Condensed Matter and Surface Science Program at Ohio University, Athens, Ohio on Jun. 10, 1991, there is described thick chemical vapor deposited "CVD" polycrystalline diamond films having been observed to emit electrons with an intensity sufficient to form an image in the accelerating field of an emission microscope without external excitation. The individual crystallites are of the order of 1–10 microns. The CVD process requires 800° C. for the depositing of the diamond film. Such a temperature would melt a glass substrate.

The prior art has failed to: (1) take advantage of the unique properties of amorphic diamond; (2) provide for field emission cathodes having a more diffused area from which field emission can occur; and (3) provide for a high enough concentration of emission sites (i.e., smaller particles or crystallites) to produce a more uniform electron emission from each cathode site, yet require a low voltage source in order to produce the required field for the electron emissions.

SUMMARY OF THE INVENTION

The prior art has failed to recognize that amorphic diamond, which has physical qualities which differ substantially from other forms of diamond, makes a particularly good emission material. U.S. Pat. No. 5,543,684 was the first to disclose use of amorphic diamond film as an emission material. In fact, in the preferred embodiment of the invention described therein, amorphic diamond film was used in conjunction with a flat cathode structure to result in a radically different field emission cathode design.

The present invention takes the utilization of amorphic diamond a step further by depositing the amorphic diamond in such a manner so that a plurality of diamond micro-crystallite regions are deposited upon the cathode surface such that at each region (pixel) there are a certain percentage of the crystals emerging in an $SP^2$ configuration and another percentage of the crystals emerging in an $SP^3$ configuration. The numerous $SP^2$ and $SP^3$ configurations at each region result in numerous discontinuities or interface boundaries between the configurations, with the $SP^2$ and $SP^3$ crystallites having different electron affinities.

Accordingly, to take advantage of the above-noted opportunities, it is a primary object of the present invention to provide an independently addressable cathode, comprising a layer of conductive material and a layer of amorphic diamond film, functioning as a low effective work-function material, deposited over the conductive material, the amorphic diamond film comprising a plurality of distributed localized electron emission sites, each sub-site having a plurality of sub-regions with differing electron affinities between sub-regions.

In a preferred embodiment of the present invention, the amorphic diamond film is deposited as a relatively flat emission surface. Flat cashodes are easier and, therefore, less expensive to manufacture and, during operation of the display, are easier to control emission therefrom.

A technical advantage of the present invention is to provide a cathode wherein emission sites have electrical properties which include discontinuous boundaries with differing electron affinities.

Another technical advantage of the present invention is to provide a cathode wherein emission sites contain dopant atoms.

Yet another technical advantage of the present invention is to provide a cathode wherein a dopant atom is carbon.

Yet a further technical advantage of the present invention is to provide a cathode wherein emission sites each have a plurality of bonding structures.

Still yet another technical advantage of the present invention is to provide a cathode wherein one bonding structure at an emission site is $SP^3$.

Still a further technical advantage of the present invention is to provide a cathode wherein each emission site has a plurality of bonding orders, one of which is $SP^3$.

Another technical advantage of the present invention is to provide a cathode wherein emission sites contain dopants of an element different from a low effective work-function material. In the case of use of amorphic diamond as the low effective work-function material, the dopant element is other than carbon.

Still another technical advantage of the present invention is to provide a cathode wherein emission sites contain discontinuities in crystalline structure. The discontinuities are either point defects, line defects or dislocations.

The present invention further includes novel methods of operation for a flat panel display and use of amorphic diamond as a coating on an emissive wire screen and as an element within a cold cathode fluorescent lamp.

In the attainment of the above-noted features and advantages, the preferred embodiment of the present invention is an amorphic diamond film cold-cathode comprising a substrate, a layer of conductive material, an electronically resistive pillar deposited over the substrate and a layer of amorphic diamond film deposited over the conductive material, the amorphic diamond film having a relatively flat emission surface comprising a plurality of distributed micro-crystallite electron emission sites having differing electron affinities.

The foregoing has outlined rather broadly the features and technical advantages of the present invention in order that the detailed description of the invention that follows may be better understood.

Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
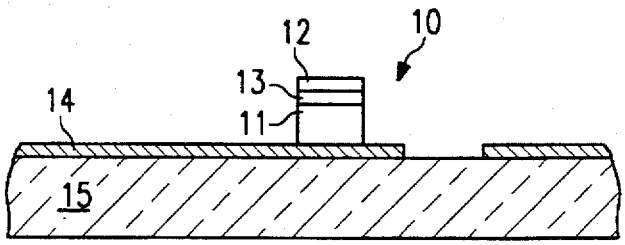
FIG. 1 is a cross-sectional representation of the cathode and substrate of the present invention.

Turning now to FIG. 1, shown is a cross-sectional representation of the cathode and substrate of the present invention. The cathode, generally designated 10, comprises a resistive layer 11, a low effective work-function emitter layer 12 and an intermediate metal layer 13. The cathode 10 sits on a cathode conductive layer 14 which, itself, sits on a substrate 15. The structure and function of the layers 11, 12, 13 of the cathode 10 and the relationship of the cathode 10 to conductive layer 14 and substrate 15 are described in detail in U.S. Pat. No. 5,543,684, which is incorporated herein by reference.

Figure 2:
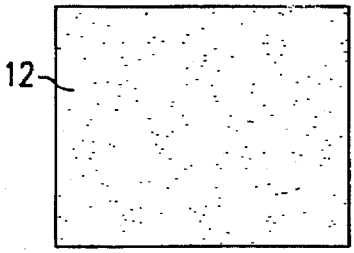
FIG. 2 is a top view of the cathode of the present invention including emission sites.

Turning now to FIG. 2, shown is a top view of the cathode 10 of FIG. 1. The emitter layer 12 is, in the preferred embodiment of the present invention, amorphic diamond film comprising a plurality of diamond micro-crystallites in an overall amorphic structure. The micro-crystallites result when the amorphic diamond material is deposited on the metal layer 13 by means of laser plasma deposition, chemical vapor deposition, ion beam deposition, sputtering, low temperature deposition (less than 500 degrees Centigrade), evaporation, cathodic arc evaporation, magnetically separated cathodic arc evaporation, laser acoustic wave deposition or similar techniques or a combination of the above whereby the amorphic diamond film is deposited as a plurality of micro-crystallites. One such process is discussed within "Laser Plasma Source of Amorphic Diamond," published by the American Institute of Physics, January 1989, by C. B. Collins, et al.

The micro-crystallites form with certain atomic structures which depend on environmental conditions during deposition and somewhat on chance. At a given environmental pressure and temperature, a certain percentage of crystals will emerge in an $SP^2$ (two-dimensional bonding of carbon atoms) configuration. A somewhat smaller percentage, however, will emerge in an $SP^3$ (three-dimensional bonding) configuration. The electron affinity for diamond micro-crystallites in an $SP^3$ configuration is less than that for carbon or graphite micro-crystallites in an $SP^2$ configuration. Therefore, micro-crystallites in the $SP^3$ configuration have a lower electron affinity, making them "emission sites." These emission sites (or micro-crystallites with an $SP^3$ configuration) are represented in FIG. 2 as a plurality of black spots in the emitter layer 12.

The flat surface is essentially a microscopically flat surface. A particular type of surface morphology, however, is not required. But, small features typical of any polycrystalline thin film may improve emission characteristics because of an increase in enhancement factor. Certain micro-tip geometries may result in a larger enhancement factor and, in fact, the present invention could be used in a micro-tip or "peaked" structure.

Figure 3:
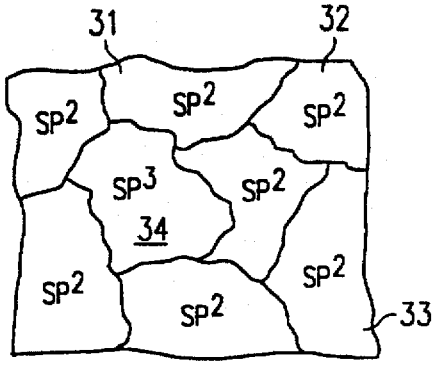
FIG. 3 is a more detailed representation of the emission sites of FIG. 2.

Turning now to FIG. 3, shown is a more detailed view of the micro-crystallites of FIG. 2. Shown is a plurality of micro-crystallites 31, 32, 33, 34, for example. Micro-crystallites 31, 32, 33 are shown as having an $SP^2$ configuration. Micro-crystallite 34 is shown as having an $SP^3$ configuration. As can be seen in FIG. 3, micro-crystallite 34 is surrounded by micro-crystallites having an $SP^2$ configuration.

There are a very large number of randomly distributed localized emission sites per unit area of the surface. These emission sites are characterized by different electronic properties of that location from the rest of the film. This may be due to one or a combination of the following conditions:

1) presence of a doping atom (such as carbon) in the amorphic diamond lattice;
2) a change in the bonding structure from $SP^2$ to $SP^3$ in the same micro-crystallite;
3) a change in the order of the bonding structure in the same micro-crystallite;
4) an impurity (perhaps a dopant atom) of an element different from that of the film material;
5) an interface between the various micro-crystallites;
6) impurities or bonding structure differences occurring at the micro-crystallite boundary; or
7) other defects, such as point or line defects or dislocations.

The manner of creating each of the above conditions during production of the film, is well known in the art.

One of the above conditions for creating differences in micro-crystallites is doping. Doping of amorphic diamond thin film can be accomplished by interjecting elemental carbon into the diamond as it is being deposited. When doping with carbon, micro-crystallites of different structures will be created statistically. Some micro-crystallites will be n-type. Alternatively, a non-carbon dopant atom could be used, depending upon the desired percentage and characteristics of emission sites. Fortunately, in the flat panel display environment, cathodes with as few as 1 emission site will function adequately. However, for optimal functioning, 1 to 10 n-type micro-crystallites per square micron are desired. And, in fact, the present invention results in micro-crystallites less than 1 micron in diameter, commonly 0.1 micron.

Emission from the cathode 10 of FIG. 1 occurs when a potential difference is impressed between the cathode 10 and an anode (not shown in FIG. 1) which is separated by some small distance from the cathode 10. Upon impression of this potential, electrons are caused to migrate to the emission layer 12 of the cathode 10.

In the example that follows, the condition that will be assumed to exist to create micro-crystallites of different work function will be a change in the bonding structure from $SP^2$ to $SP^3$ in the same micro-crystallite (condition 3 above). With respect to the emission sites shown in FIGS. 2 and 3, micro-crystallites having an $SP^3$ configuration have a lower work-function and electron affinity than micro-crystallites having an $SP^2$ configuration. Therefore, as voltage is increased between the cathode 10 and anode (not shown), the voltage will reach a point at which the $SP^3$ micro-crystallites will begin to emit electrons. If the percentage of $SP^3$ micro-crystallites on the surface of the cathode 10 is sufficiently high, then emission from the $SP^3$ micro-crystallites will be sufficient to excite the anode (not shown), without having to raise voltage levels to a magnitude sufficient for emission to occur from the $SP^2$ micro-crystallite. Accordingly, by controlling pressure, temperature and method of deposition of the amorphic diamond film in a manner which is well-known in the art, $SP^3$ micro-crystallites can be made a large enough percentage of the total number of micro-crystallites to produce sufficient electron emission.

Figure 4:
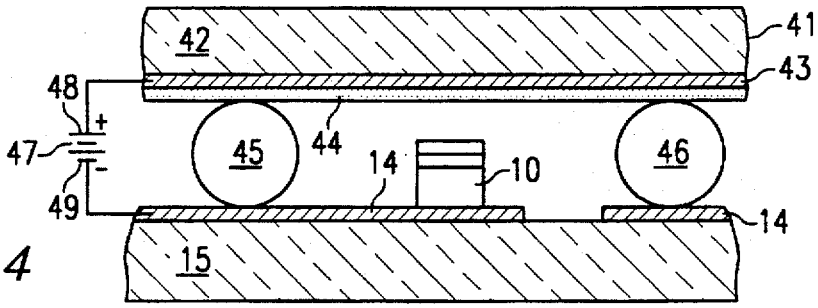
FIG. 4 is a cross-sectional view of a flat panel display employing the cathode of the present invention.

Turning now to FIG. 4, shown is a cross-sectional view of a flat panel display employing the cathode of the present invention. The cathode 10, still residing on its cathode conductive layer 14 and substrate 15 as in FIG. 1, has been mated to an anode, generally designated 41 and comprising a substrate 42, which in the preferred embodiment is glass. The substrate 42 has an anode conductive layer 43 which, in the preferred embodiment, is an indium tin oxide layer. Finally, a phosphor layer 44 is deposited on the anode conductive layer to provide a visual indication of electron flow from the cathode 10. In other words, when a potential difference is impressed between the anode 41 and the cathode 10, electrons flowing from the cathode 10 will flow toward the anode conductive layer 43 but, upon striking the phosphor layer 44, will cause the phosphor layer to emit light through the glass substrate 42, thereby providing a visual display of a type desirable for use in conjunction with computers or other video equipment. The anode 41 is separated by insulated separators 45, 46 which provide the necessary separation between the cathode 10 and the anode 41. This is all in accordance with the device described in U.S. Pat. No. 5,543,684.

Further, in FIG. 4, represented is a voltage source 47 comprising a positive pole 48 and a negative pole 49. The positive pole is couple from the source 47 to the anode conductive layer 43, while the negative pole 49 is coupled from the source 47 to the cathode conductive layer 14. The device 47 impresses a potential difference between the cathode 10 and the anode 41, causing electron flow to occur between the cathode 10 and the anode 41 if the voltage impressed by the source 47 is sufficiently high.

Figure 9:
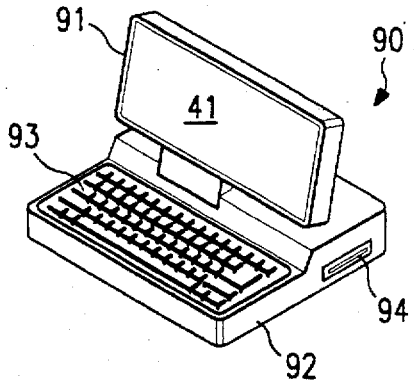
FIG. 9 is a computer with a flat-panel display that incorporates the present invention.

Turning now to FIG. 9, there is illustrated computer 90 with associated keyboard 93, disk drive 94, hardware 92 and display 91. The present invention may be employed within display 91 as a means for providing images and text. All that is visible of the present invention is anode 41.

Figure 5:
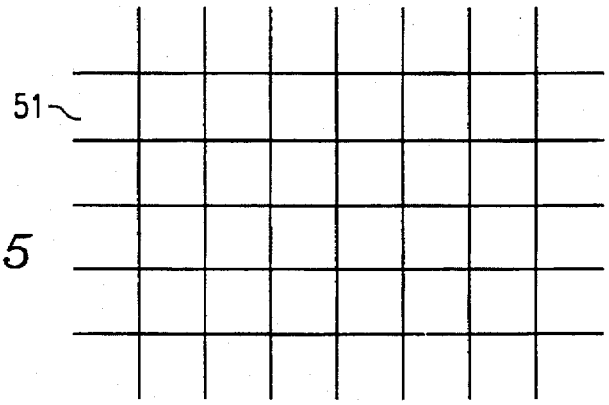
FIG. 5 is a representation of a coated wire matrix emitter.

Turning now to FIG. 5, shown is a representation of a coated wire matrix emitter in the form of a wire mesh, generally designated 51. The wire mesh 51 comprises a plurality of rows and columns of wire which are electrically joined at their intersection points. The wire mesh 51 is then coated with a material having a low effective work-function and electron affinity, such as amorphic diamond, to thereby produce a wire mesh cathode for use in devices which previously used an uncoated wire or plate cathode and application of a high current and potential difference to produce incandescence and a flow of electrons from the mesh to an anode. By virtue of the amorphic diamond coating and its associated lower work function, incandescence is no longer necessary. Therefore, the wire mesh 51 cathode can be used at room temperature to emit electrons.

Figure 6:
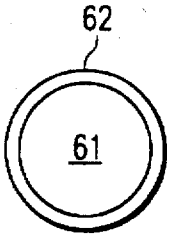
FIG. 6 is a cross-sectional view of a coated wire.

Turning now to FIG. 6, shown is a cross-section of a wire which has been coated with a material having a low work-function and electron affinity. The wire, designated 61, has a coating 62 which has been deposited by laser plasma deposition, or any one of the other well-known techniques listed above to thereby permit the coating 62 to act as a cold cathode in the same manner as the cathodes described in FIGS. 1–5.

Figure 7:
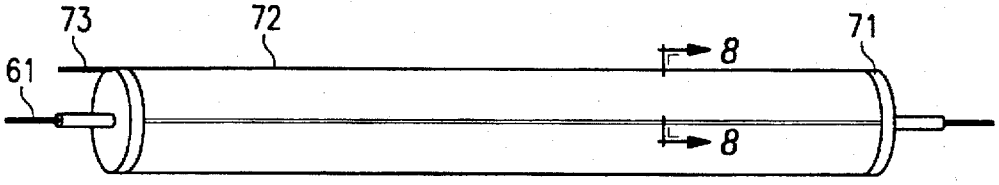
FIG. 7 is a side view of a florescent tube employing the coated wire of FIG. 6.

Turning now to FIG. 7, shown is one application of the wire 61 in which the coated wire 61 functions as a conductive filament and is surrounded by a glass tube 72, functioning as an anode and which has an electrical contact 73 to thereby produce a fluorescent tube. The tube functions in a manner which is analogous to the flat panel display application discussed in connection with FIGS. 1–5, that is, a potential difference is impressed between the wire 61 (negative) and the tube 72 sufficient to overcome the space-charge between the cathode wire 61 and the tube anode 72. Once the space-charge has been overcome, electrons will flow from emission site $SP^3$ micro-crystallites in the coating 62.

Figure 8:
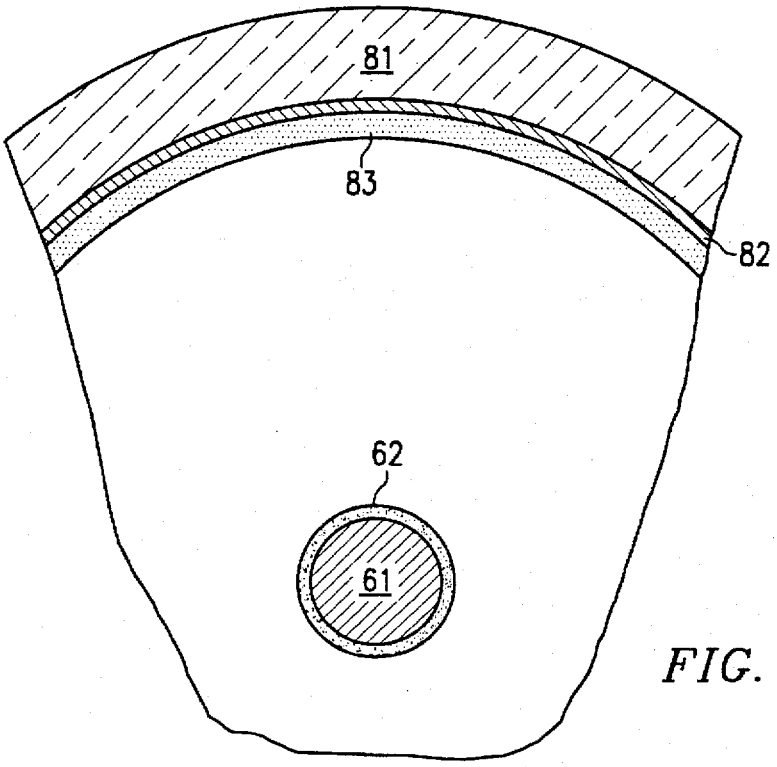
FIG. 8 is a partial section end view of the fluorescent tube of FIG. 7.

Turning now to FIG. 8, shown is a partial section end view of the florescent tube 71 of FIG. 7. Shown again are the wire 61 and the coating 62 of FIG. 6 which, together, form a low effective work-function cathode in the fluorescent tube 71. The glass tube 72 of FIG. 7 comprises a glass wall 81 on which is coated an anode conductive layer 82. The anode conductive layer 82 is electrically coupled to the electrical contact 73 of FIG. 7. Finally, a phosphor layer 83 is deposited on the anode conductive layer 82. When a potential difference is impressed between the cathode wire 61 and the anode conductive layer 82, electrons are caused to flow between the emitter coating 82 and the anode conductive layer 82. However, as in FIG. 4, the electrons strike the phosphor layer 83 first, causing the phosphor layer 83 to emit photons through the glass wall 81 and outside the florescent tube 71, thereby providing light in a manner similar to conventional fluorescent tubes. However, because the fluorescent tube of FIGS. 7 and 8 employs a cathode having a low effective work-function emitter, such as amorphic diamond film, the fluorescent tube does not get warm during operation. Thus, the energy normally wasted in traditional fluorescent tubes in the form of heat is saved. In addition, since the heat is not produced, it need not be later removed by air conditioning.

Although the present invention and its advantages have been described in detail, it should be understood that various changes, substitutions and alterations can be made herein without departing from the spirit and scope of the invention as defined by the appended claims.

What is claimed is:

1. A display device comprising a plurality of cathodes each selectively controllable to form images on a surface of a screen, said cathodes each comprising:

a layer of conductive material; and a layer of low effective work-function material deposited over said conductive material, said low work-function material having an emission surface comprising a plurality of distributed localized electron emission sites, wherein said emission sites at said emission surface are relatively flat.

2. The display device screen as recited in claim 1 wherein said emission sites have electrical properties which are discontinuous from each other.

3. The display device as recited in claim 1 wherein said emission surface is relatively flat.

4. The display device as recited in claim 1 wherein said sites each have at least two different electron affinities.

5. The display device as recited in claim 1 wherein each said site is under 1 micron in diameter.

6. The display device as recited in claim 1 wherein some of said low effective work-function material is amorphic diamond.

* * * * *